US007810808B2

(12) United States Patent
Hamahashi

(10) Patent No.: US 7,810,808 B2
(45) Date of Patent: Oct. 12, 2010

(54) IMAGE FORMING APPARATUS, SHEET-CONVEYANCE CONTROL METHOD, AND SHEET-CONVEYANCE CONTROL PROGRAM

(75) Inventor: Shunsuke Hamahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 11/893,280

(22) Filed: Aug. 14, 2007

(65) Prior Publication Data

US 2008/0048392 A1 Feb. 28, 2008

(30) Foreign Application Priority Data

Aug. 22, 2006 (JP) ..... 2006-225592

(51) Int. Cl.
*B65H 9/04* (2006.01)

(52) U.S. Cl. ..... 271/242; 271/227; 271/10.03; 271/4.03

(58) Field of Classification Search ..... 271/242, 271/226, 227, 10.03, 4.03
See application file for complete search history.

(56) References Cited

U.S. PATENT DOCUMENTS 5,927,703 A * 7/1999 Endo ..... 271/10.03
5,967,506 A * 10/1999 Miki et al. ..... 271/10.13
2006/0214365 A1* 9/2006 Yasui et al. ..... 271/242
2007/0158895 A1 7/2007 Hamahashi et al.

FOREIGN PATENT DOCUMENTS

JP 6-56302 3/1994
JP 6-80273 3/1994

OTHER PUBLICATIONS

U.S. Appl. No. 11/713,506, filed Mar. 2, 2007.

* cited by examiner

*Primary Examiner*—Patrick Mackey
*Assistant Examiner*—Ernesto Suarez
(74) *Attorney, Agent, or Firm*—Cooper & Dunham LLP

(57) ABSTRACT

A register roller conveys a recording sheet to a transfer position. A sheet feed roller conveys the recording sheet toward the register roller. A conveyance control unit controls rotation-start timings of the register roller and the sheet feed roller in such a manner that a rotation-start timing of the sheet feed roller is prior to a rotation-start timing of the register roller at a time of starting a registering process to convey the recording sheet to the transfer position at a right timing with the image formed on the image carrier.

20 Claims, 10 Drawing Sheets

IMAGE FORMING APPARATUS, SHEET-CONVEYANCE CONTROL METHOD, AND SHEET-CONVEYANCE CONTROL PROGRAM

CROSS-REFERENCE TO RELATED APPLICATIONS

The present application claims priority to and incorporates by reference the entire contents of Japanese, patent application no. 2006-225592 filed in Japan on Aug. 22, 2006.

BACKGROUND OF THE INVENTION

1. Technical Field

This disclosure relates to a technology for conveying a recording sheet to a transfer position at an appropriate timing with an image formed on a moving image carrier.

2. Description of the Related Art

Many of image forming apparatuses, such as copiers and printers, that have become proliferate nowadays employ methods of: cyclically scanning (in a main scanning direction) a photoconductor drum that rotates (in a sub-scanning direction) with a laser beam being turned on and off according to image data, thereby forming a two-dimensional latent image on the photoconductor drum; developing a toner image, and transferring the image from the photoconductor drum or an intermediate transfer member, serving as an image carrier, onto a paper medium (recording sheet) at a transfer position. This method requires to appropriately convey the recording sheet (hereinafter, "sheet") to the transfer position in timed relation to the image formed on the moving image carrier.

Such a sheet conveyance is generally performed using a feed roller that feeds a sheet from a tray, in which sheets are stored in a stacked manner, and a register roller provided immediately upstream of the transfer position. The related art will be described with reference to FIGS. 1 and 2 because the device configuration (hardware) for performing the sheet conveyance of the related art is identical with that of the present invention, which will be described later with reference to FIGS. 1 and 2.

With reference to FIG. 1, a toner image carried on a moving intermediate transfer belt 105 is transferred from the belt to a sheet 104 having been conveyed from a sheet feed tray 101 by a pair of secondary transfer rollers 107 and 116. First, only a sheet feed roller 102 is driven to deliver sheets stacked and stored in the sheet feed tray 101 one by one to a registration standby position. Simultaneously, a timer starts time measurement from a point in time where a registration sensor 120 for sensing arrival of the sheet senses a leading edge of the sheet. After a lapse of a predetermined period, the sheet feed roller 102 is stopped. The predetermined period of time set to the timer is a period of time after which a sheet is expected to be resiliently flexed into abutment against register rollers 103. The register rollers 103 are disposed immediately upstream of the secondary transfer rollers 107 and 116, and deliver the sheet at the registration standby position to the secondary transfer rollers 107 and 116 in accordance with a command to start registration issued in timed relation to movement of the toner image carried on the moving intermediate transfer belt 105.

The series of sheet conveyance operations is performed by controlling actuations of the sheet feed roller 102 and the register rollers 103. More specifically, the sheet conveyance operations are performed such that a central processing unit (CPU) 211 in a controller 210 of a control system shown in FIG. 2 executes a program for use in the operations for controlling a device group, e.g., the registration sensor 120, and a motor and clutches of a sheet conveyor 230.

FIG. 9 is a flowchart of a conventional sheet-conveyance control procedure performed in the prior-to-registration process.

As shown in FIG. 9, first, a sheet feed clutch 232 is turned on to cause the sheet feed roller 102 to convey the sheet 104 on the sheet feed tray 101 toward the register rollers 103 (step S1101).

Subsequently, the registration sensor 120 disposed on a transport path extending to the register rollers 103 senses a leading edge of the sheet 104 being conveyed (step S1102). Whether a preset period, after which the sheet is expected to be resiliently flexed into abutment against the register roller 103, has elapsed since the registration sensor 120 has sensed the leading edge of the sheet 104 is determined (step S1103).

When the preset period of time is determined to have elapsed (YES at step S1103), the sheet feed roller 102 is stopped. This state is referred to as a registration standby state, and maintained until a registration starting time.

Meanwhile, the registration starting time is in timed relation to arrival of the toner image carried on the intermediate transfer belt 105 at the secondary transfer roller 116. At the instant when the registration starting time has come (YES at step S1105), the sheet feed clutch 232 and a registration clutch 233 are turned on to cause the sheet feed roller 102 and the register rollers 103 to start rotation, thereby starting registration (step S1106).

After registration is started, processing moves to a subsequent process in which the secondary transfer roller 116 transfers the toner image onto the sheet, and thereafter to a process in which a fixing unit 122 fixes the toner image onto the sheet.

However, even when a command for causing the sheet feed roller 102 and the register roller 103 to start rotation simultaneously is issued in the prior-to-registration process as in the conventional control procedure shown in FIG. 9, the sheet feed roller 102 and the register rollers 103 do not necessarily start rotation at the same time due to fluctuations in engagement duration of the sheet feed clutch 232 and that of the registration clutch 233, and the like.

When the register rollers 103 start rotation earlier than the sheet feed roller 102, the sheet must be conveyed by a conveying force exerted only by the register rollers 103. When the degree of resilient flexure of the sheet is small in this state, the sheet becomes less flexible and receives a load from the sheet feed roller 102, which results in skid of the sheet. Accordingly, timing between arrival of the toner image carried on the intermediate transfer belt 105 at the secondary transfer roller 116 and sheet feeding is desynchronized. This result in misregistration of the leading edge of an image formed on the sheet.

Conventionally, sheet-feed control methods that control sheet conveyance operations according to a pre-determined appropriate degree of resilient flexure have been proposed (see Japanese Patent Application Laid-open No. H6-56302). According to the method described in Japanese Patent Application Laid-open No. H6-56302, the sheet conveyance operation to a registration position is feedback controlled. More specifically, the degree of resilient flexure is estimated based on a previously detected travel (number of pulses) of a sheet having been conveyed, and the sheet conveyance operation is feedback controlled so that sheet undergoes an appropriate degree of resilient flexure.

Hence, the method disclosed in Japanese Patent Application Laid-open No. H6-56302 that allows appropriate conveyance of a sheet is not premised on such a sheet that is insufficiently flexed at the registration standby position. Furthermore, the method disclosed in Japanese Patent Application Laid-open No. H6-56302 requires a sensor for detecting a rear end of a sheet in addition to the registration sensor and calculations for estimating the degree of resilient flexure based on a conveyance travel detected with at least the two sensors and a target value. These requirements serve as constraints.

BRIEF SUMMARY

In an aspect of this disclosure, there is provided an image forming apparatus that includes an image forming unit that forms an image on a moving image carrier; a register roller that conveys a recording sheet onto which the image carrier transfers the image to a transfer position; a sheet feed roller that conveys the recording sheet toward the register roller; and a conveyance control unit that conveys the recording sheet to the transfer position at a right timing with the image formed on the image carrier by driving the sheet feed roller and the register roller in accordance with a series of control operations. The conveyance control unit controls rotation-start timings of the register roller and the sheet feed roller in such a manner that the recording sheet is conveyed in a state of being resiliently flexed to a position close to make a contact with the register roller by exclusively driving the sheet feed roller, and then the register roller is driven at the right timing with the image formed on the image carrier so that a rotation-start timing of the sheet feed roller is prior to a rotation-start timing of the register roller at a time of starting a registering process to convey the recording sheet to the transfer position.

In another aspect of this disclosure, there is provided a method for controlling a conveyance of a sheet for an image forming apparatus that includes an image forming unit that forms an image on a moving image carrier, a register roller that conveys a recording sheet onto which the image carrier transfers the image to a transfer position, a sheet feed roller that conveys the recording sheet toward the register roller, and a conveyance control unit that conveys the recording sheet to the transfer position at a right timing with the image formed on the image carrier by driving the sheet feed roller and the register roller in accordance with a series of control operations. The method includes conveying the recording sheet in a state of being resiliently flexed to a position close to make a contact with the register roller by exclusively driving the sheet feed roller; and driving the register roller at the right timing with the image formed on the image carrier so that a rotation-start timing of the sheet feed roller is prior to a rotation-start timing of the register roller at a time of starting a registering process to convey the recording sheet to the transfer position.

The above and other aspects, features, advantages, etc., will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image forming apparatus according to the present invention are explained in detail below with reference to the accompanying drawings.

The following are embodiments of aspects of the present invention, each embodied as a color-image forming apparatus. Note that the image forming apparatus can be embodied as a monochrome image forming apparatus in the similar manner as in the following embodiments.

First, a basic configuration of the image forming apparatus according to the embodiments will be described with reference to a schematic configuration of an example apparatus shown in FIG. 1.

Figure 1A:
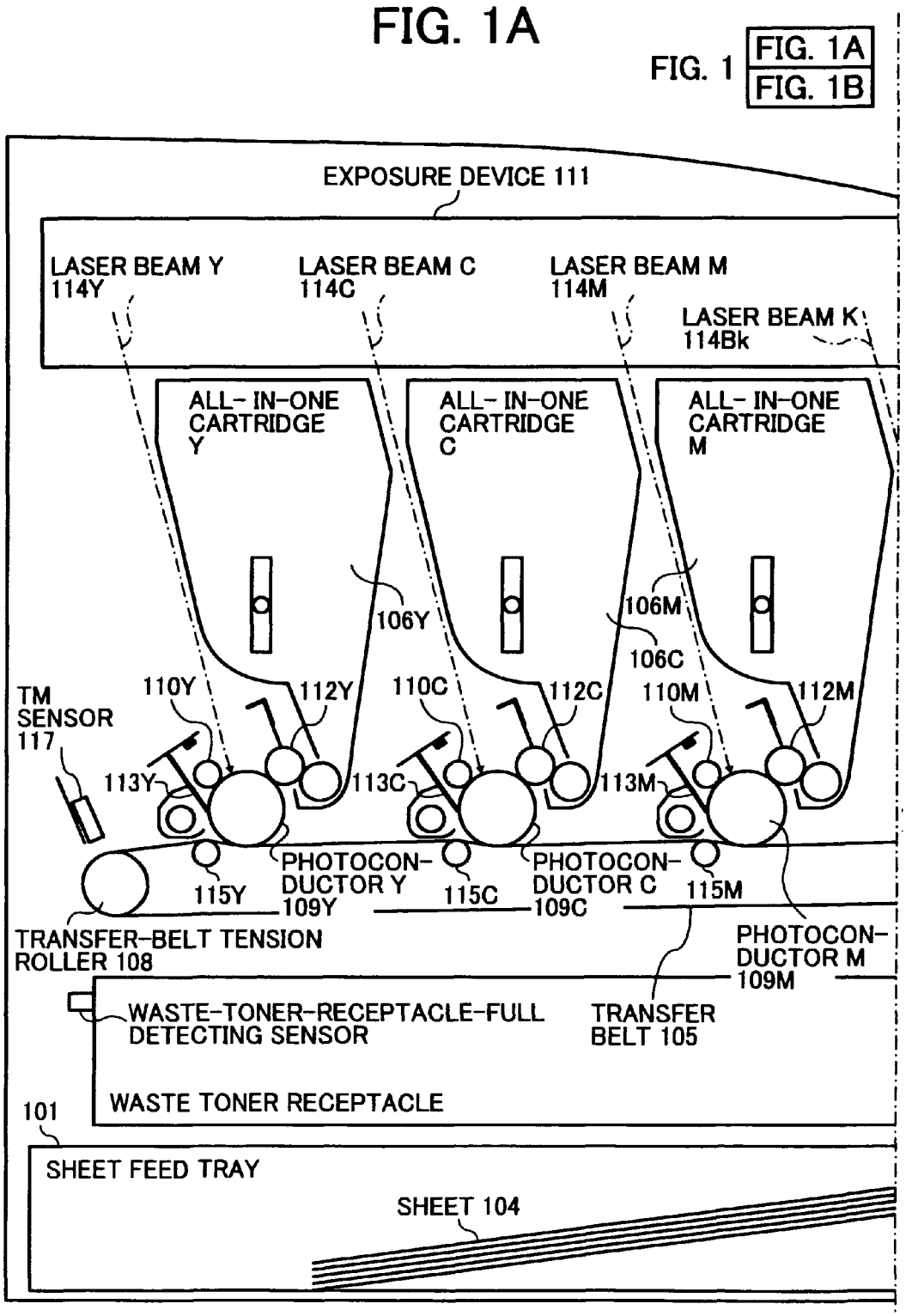
FIG. 1 is a schematic configuration diagram of an image forming apparatus according to an embodiment of the present invention.
Figure 1B:
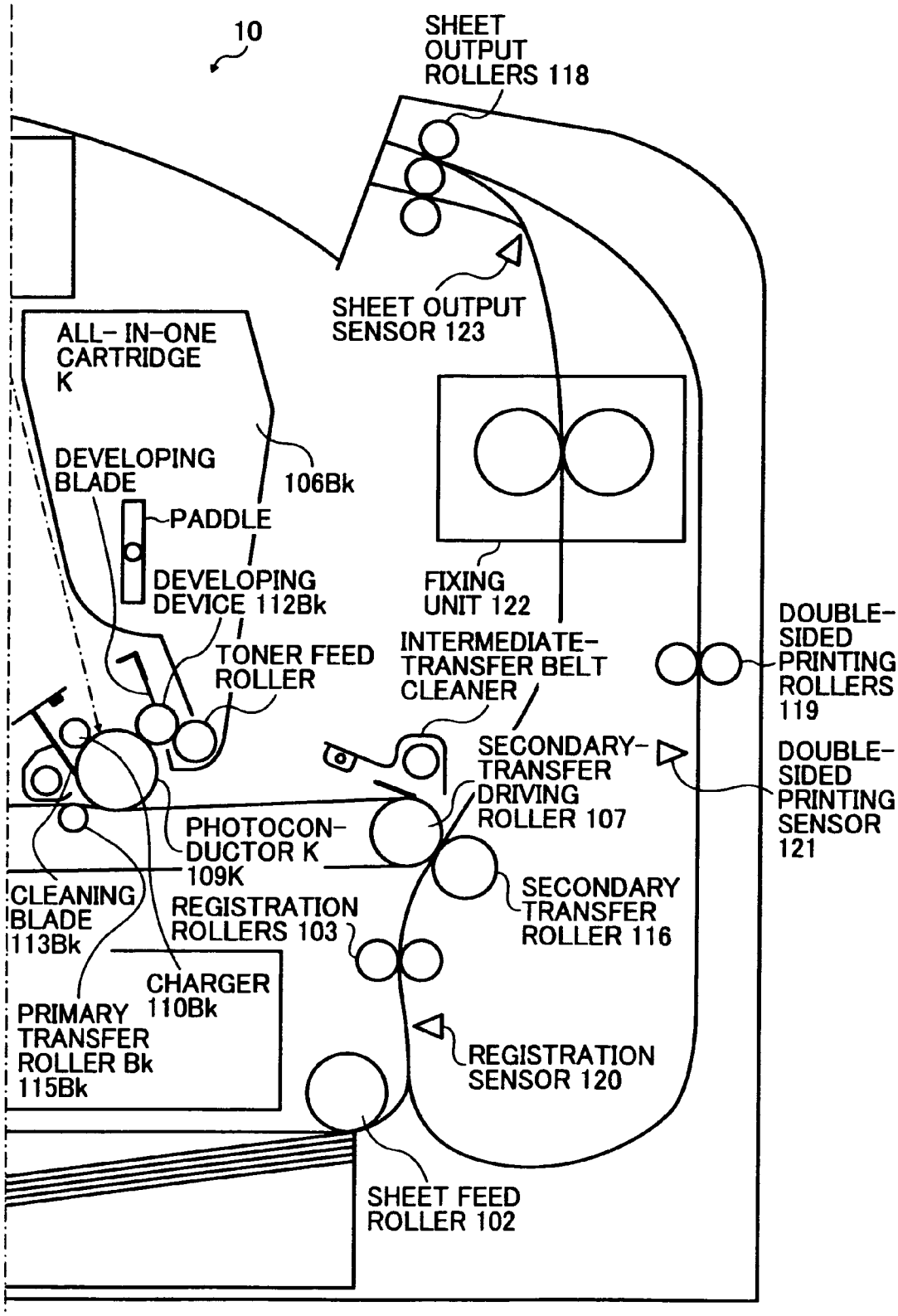

A color-image forming apparatus 10 shown in FIG. 1 is a tandem type color-image forming apparatus. An image of a corresponding color component is formed on each of photoconductor drums 109BK, 109M, 109C, and 109Y. During the process of transferring the images from the drums to the intermediate transfer belt (hereinafter, "transfer belt") 105, the images are superimposed one another to form a color image. Hence, all-in-one cartridges 106BK, 106M, 106C, and 106Y of each corresponding color are arranged along the transfer belt 105 with regular intervals therebetween. With reference to FIG. 1, the transfer belt 105 rotates counterclockwise. From upstream of the rotating direction, the all-in-one cartridges (each integrated with an electrophotographic processing unit, which is a replaceable part) 106BK, 106M, 106C, and 106Y are arranged along the transfer belt 105 in this order.

The all-in-one cartridges (hereinafter, "cartridges") 106BK, 106M, 106C, and 106Y are identical in internal structure except that the images formed by the cartridges are different from one another in color. The cartridge 106BK forms a black image, the cartridge 106M forms a magenta image, the cartridge 106C forms a cyan image, and the cartridge 106Y forms a yellow image.

While, in the following descriptions, only the cartridge 106BK will be specifically described, image forming units each formed with a corresponding one of the other cartridges 106M, 106C, and 106Y having the same configuration as that of the cartridge 106BK are only indicated in the drawings by reference symbols M, C, and Y added to each constituent of the image forming units for identification in place of the reference symbol BK added to each constituent of the cartridge 106BK, and descriptions on the cartridges 106M, 106C, and 106Y are omitted.

The transfer belt 105 is an endless belt spanned around the secondary-transfer driving roller 107 and a transfer-belt tension roller 108, which are driven to rotate. The secondary-transfer driving roller 107 is rotated by a drive motor (not shown). The drive motor, the secondary-transfer driving roller 107, and the transfer-belt tension roller 108 function as a driving unit to move the transfer belt 105.

The image forming unit includes the photoconductor 109BK to be scanned with a laser beam, a charger 110BK, an exposure device 111, a developing device 112BK, and a cleaning blade 113BK, which are disposed around the photoconductor 109BK.

The exposure device 111 emits, as exposure light, laser beams 114BK, 114M, 114C, and 114Y corresponding to image colors formed by the cartridges 106BK, 106M, 106C, and 106Y. A laser is turned on and off to emit a laser beam of one of the image colors in accordance with image data of the color. The laser beam is then deflected by a deflector (polygon mirror) and subjected to scanning (in main scanning direction) of the rotating (in sub-scanning direction) photosensitive drum, thereby exposing a photosensitive surface of the drum.

The outer peripheral surface of the photoconductor 109BK is uniformly electrified by the charger 110BK in a dark chamber, and exposed by the laser beam 114BK that is emitted from the exposure device 111 and that corresponds to a black image, thereby forming an electrostatic latent image.

The developing device 112BK causes black toner to stick to the electrostatic latent image formed on the photoconductive surface, thereby rendering the image visible. Through the processes, a black toner image is formed on the photoconductor 109BK.

According to the image forming process, an image is formed by scanning the rotating photoconductor drum with a laser beam. As the drum 109BK rotates, the toner image on the photoconductor drum 109BK is conveyed toward the transfer position (primary transfer position) at which the drum 109BK and the transfer belt 105 contact each other. At the transfer position, the toner image is transferred onto the transfer belt 105 through a primary transfer roller 115BK. Thus, a black toner image is formed on the transfer belt 105.

The photoconductor 109BK, from which the toner image has been transferred and residual toner on the outer peripheral surface is removed by the cleaning blade 113BK, enters a standby state for a subsequent image forming process.

As described above, the transfer belt 105, on which the black toner image has been transferred by the cartridge 106BK, conveys the black toner image to a position where the subsequent cartridge 106M is disposed. At the cartridge 106M, a magenta toner image is formed on the photoconductor 109M through the same image forming process performed by the cartridge 106BK, and the toner image is transferred onto the transfer belt 105 to thus be superimposed on the black image formed on the transfer belt 105.

The image formed on the transfer belt 105 is further conveyed to the cartridges 106C and 106Y, where a cyan toner image on the photoconductor 109*c* and a yellow toner image on the photoconductor 109Y, each having been formed through the same process, are transferred onto the transfer belt 105 and superimposed on the image formed on the transfer belt 105. Thus, a full-color image is formed on the transfer belt 105. The transfer belt 105, on which the full-color image is formed, is moved to the secondary transfer roller 116. For forming only a monochrome image of, e.g., black, only the cartridge 106BK is actuated to perform the image forming process with primary transfer rollers 115M, 115C, and 115Y being retracted to positions separated from the photoconductors 109M, 109C, and 109Y, respectively.

The color image transferred onto the transfer belt 105 through the image forming process is thereafter conveyed to the secondary transfer roller 116, at which the image is transferred onto the sheet 104. In the secondary transfer process, the sheet 104 stored in the sheet feed tray 101 in a stacked manner is conveyed to the transfer position in timed relation to the image formed on the moving transfer belt 105. A control procedure performed to attain this sheet conveyance is associated with the scope of the invention. Therefore, its details will be described later.

The sheet 104 on which the toner image is transferred from the transfer belt 105 by the secondary transfer roller 116 is conveyed to the fixing unit 122 disposed on a transport path to an output sheet receptacle. In the fixing unit 122, the transferred toner image is fixed to the sheet 104 to complete printing. Upon completion of printing, the sheet 104 is discharged to the output sheet receptacle by sheet output rollers 118.

Whereas printing on a first side of a sheet is performed as described above, printing on a second side to be performed in a double-sided printing mode is carried out by switching a sheet-output solenoid (not shown) provided at the sheet output rollers 118. When the solenoid is switched, the sheet output rollers 118 rotate reverse, whereby the sheet 104 is advanced backward to double-sided printing rollers 119. The sheet 104 is then conveyed along a double-sided printing transport path to the secondary transfer roller 116, where an image is transferred onto the second side of the sheet 104. The sheet 104 is thereafter subjected to the fixing process and discharged to complete the double-sided printing operations.

The present invention provides a sheet-conveyance control method for controlling conveyance of a recording sheet to a transfer position in timed relation to a toner image formed on the moving image carrier (the transfer belt 105). Hence, the method will be described in detail with reference to an exemplary embodiment of the present invention shown in FIG. 1.

Sheet conveyance is performed such that the sheet feed roller 102 and the register rollers 103 convey the sheet 104 stored in the sheet feed tray 101 in a stacked manner. The register rollers 103 are disposed immediately upstream of the transfer position on the transport path extending to the to the secondary transfer roller 116. The secondary transfer roller 116 transfers an image onto the sheet 104.

The toner image carried on the transfer belt 105 is conveyed to the transfer position by the secondary-transfer driving roller 107 and the secondary transfer roller 116, which form a pair. At the transfer position, the toner image is transferred from the transfer belt 105 onto the sheet 104 having been delivered from the sheet feed tray 101.

Operations performed to convey the sheet 104 from the sheet feed tray 101 to the secondary transfer position will be described. First, only the sheet feed roller 102 is driven to deliver sheets stacked and stored in the sheet feed tray 101 one by one to the registration standby position. At this time, the controller 210 receives a detection signal of a leading edge of the sheet 104 from the registration sensor 120 that detects arrival of the sheet 104. Upon receipt of the detection signal, the controller 210 starts time measurement with a timer. After a lapse of predetermined period of time measured with the timer, the sheet feed roller 102 is stopped. Thus, the sheet 104 enters the registration standby state.

The predetermined period of time set to the timer is a period of time after which a sheet is expected to be resiliently flexed into abutment against a combination of register rollers 103. In other words, because the register rollers 103 are not rotating in this state, the sheet 104 fed by the sheet feed roller 102 comes into contact with the register rollers 103 without being transported forward. When being further fed, the sheet 104 is resiliently flexed. Because an appropriate degree of resilient flexure is already determined from practical experience, the set value for the timer is determined to attain the appropriate degree.

The register rollers 103 disposed immediately upstream of the pair of secondary transfer rollers 107 and 116 start rotation in accordance with a registration-start command that is issued in timed relation to movement of the toner image carried on the moving intermediate transfer belt 105. During normal operation, the sheet 104 is in the registration standby state while being resiliently flexed by an appropriate degree. Hence, as the register rollers 103 rotate, the sheet 104 at the standby position is smoothly fed to the pair of secondary transfer rollers 107 and 116.

Figure 2:
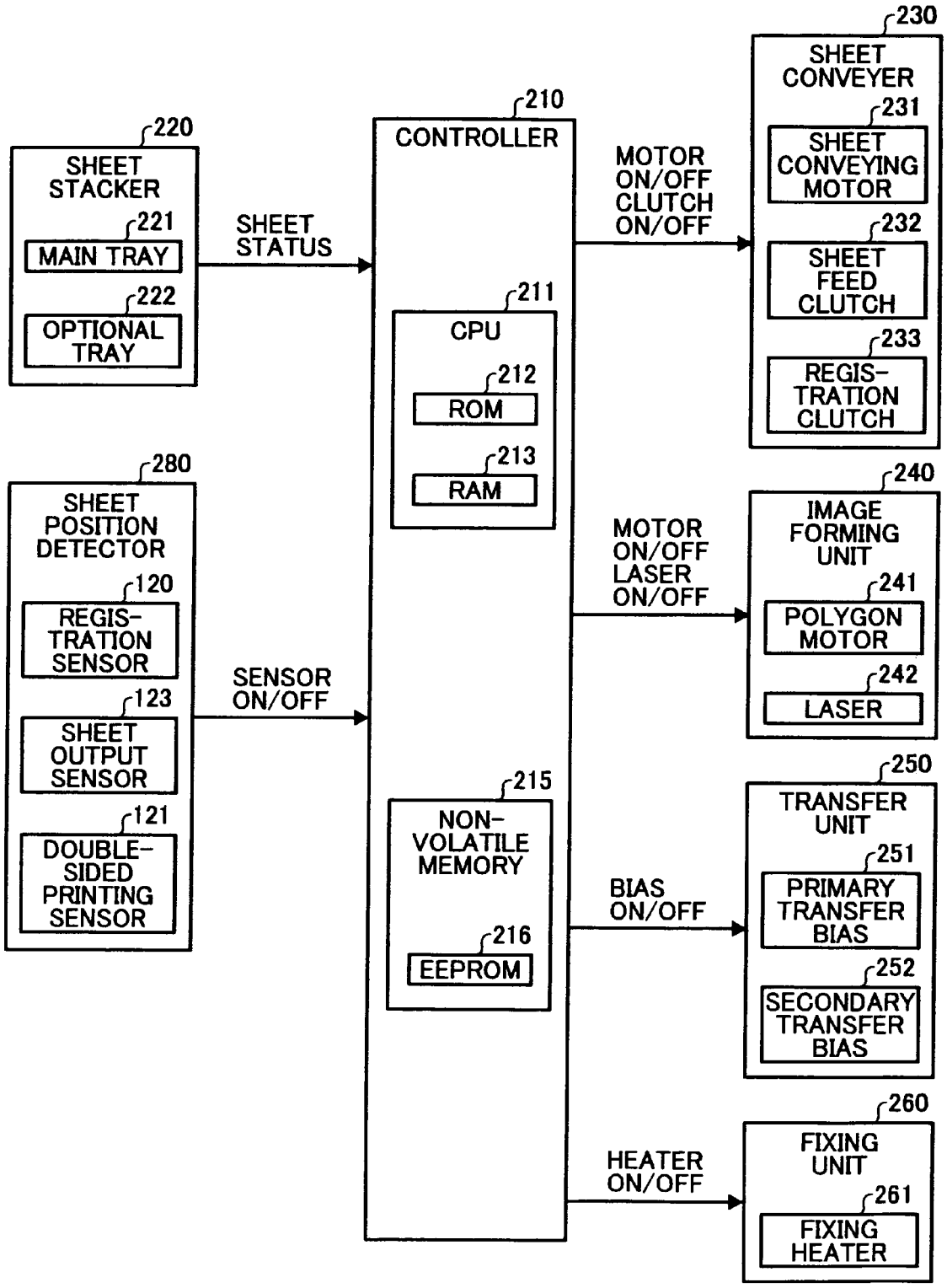
FIG. 2 depicts a configuration of a control system related to an image forming process shown in FIG. 1.

FIG. 2 is a system configuration of the control system related to the image forming process.

With reference to FIG. 2, the controller 210 controls the sheet conveyor 230, an image forming unit 240, a transfer unit 250, and a fixing unit 260. To control these units, the controller 210 obtains data from various sensors, a main controller (not shown), and the like to detect the statuses of a sheet stacker 220 and a sheet position detector 280.

When the controller 210 receives a print request from the main controller, the controller 210 performs control operations related to the image forming process. More specifically, the CPU 211 in the controller 210 controls read only memory (ROM) 212 and random access memory (RAM) 213, both controlled by the CPU 211, thereby performing operations for controlling each unit using various control programs and control data stored in the ROM 212 and the RAM 213, and issues control commands.

The control operations performed by the CPU 211 include operations defined in a control procedure that is necessary for the series of operations performed for conveying a sheet from the sheet feed tray 101 to the secondary transfer position.

The sheet conveyance control has been conventionally performed through a procedure similar to that described above by a control system that is substantially similar to the system described above. Specifically, according to the control procedure performed by the conventional control system, a sheet is placed in the registration standby state while being resiliently flexed by an appropriate degree. The register rollers 103 and the sheet feed roller 102 are caused to start rotation simultaneously in timed relation to movement of the toner image carried on the transfer belt 105 so that the sheet at the standby position is smoothly led to the transfer position (refer to the description in the Background section herein of the sheet conveyance performed in the prior-to-registration process.

Note that even when control is performed in an attempt to cause the rollers to start rotation simultaneously, the rollers do not necessarily start rotation at the same time in actual operations due to differences in characteristics of rotary drive mechanisms, and the like. If the register rollers 103 start rotation earlier than the sheet feed roller 102, a sheet must be conveyed by a conveying force exerted only by the register rollers 103. When the degree of resilient flexure of the sheet is small, the sheet is stiffened and receives a load from the sheet feed roller 102 that has not started rotation yet. This undesirably results in skid of the sheet. Consequently, timing between arrival of the toner image carried on the intermediate transfer belt 105 at the secondary transfer roller 116 and sheet feeding is desynchronized, which results in misregistration of an image formed on the sheet.

In view of the above circumstances, it is an object of the present invention to provide a control method that complements an insufficient resilient flexure of a sheet that can cause skid of the sheet, thereby preventing the misregistration.

Specifically, in the prior-to-registration process; that is, when a sheet in the registration standby state is conveyed to the transfer position, a rotation-start timing is controlled such that the sheet feed roller 102 is driven prior to the register rollers 103. This rotating-feed-roller-beforehand control performed in the prior-to-registration process allows the degree of flexure of the sheet to increase. Hence, the register rollers 103 to be actuated after the sheet feed roller 102 is actuated are allowed to start rotation in a state where the sheet is resiliently flexed by an appropriate degree.

Thus, according to the invention, such an inconvenience, which can occur in the conventional control method, that insufficient flexure of the sheet causes the sheet to receive a load from the sheet feed roller 102 can be prevented, and hence smooth conveyance of sheets is attained.

First to sixth embodiments of the present invention each employing the rotating-feed-roller-beforehand control for the prior-to-registration process, i.e., for the process of conveying a sheet in the registration standby state to the transfer position, will be described below.

The first embodiment is associated with basic control operations according to the method of the invention.

The second to fifth embodiments each based on the first embodiment are devised for optimization of the sheet conveyance operations by making it possible to determine a rotation-start timing of the sheet feed roller in accordance with a sheet type, the temperature and humidity, a type of the sheet feed roller, and a time-varying change of the sheet feed roller, each affecting the degree of resilient flexure of the sheet.

The sixth embodiment allows compensating for an inter-device difference by manual setting.

The first embodiment is a basic mode of the sheet conveyance control that employs, in the prior-to-registration process, the rotating-feed-roller-beforehand control of actuating the sheet feed roller 102 prior to the register rollers 103.

The series of sheet conveyance operations is performed by controlling actuations of the sheet feed roller 102 and the register rollers 103. More specifically, the sheet conveyance operations are performed such that the CPU 211 in the controller 210 of the control system shown in FIG. 2 executes a program for performing operations according to the following control procedure (FIG. 3) to control the device group, e.g., the registration sensor 120, and the motor and clutches of the sheet conveyor 230.

Figure 3:
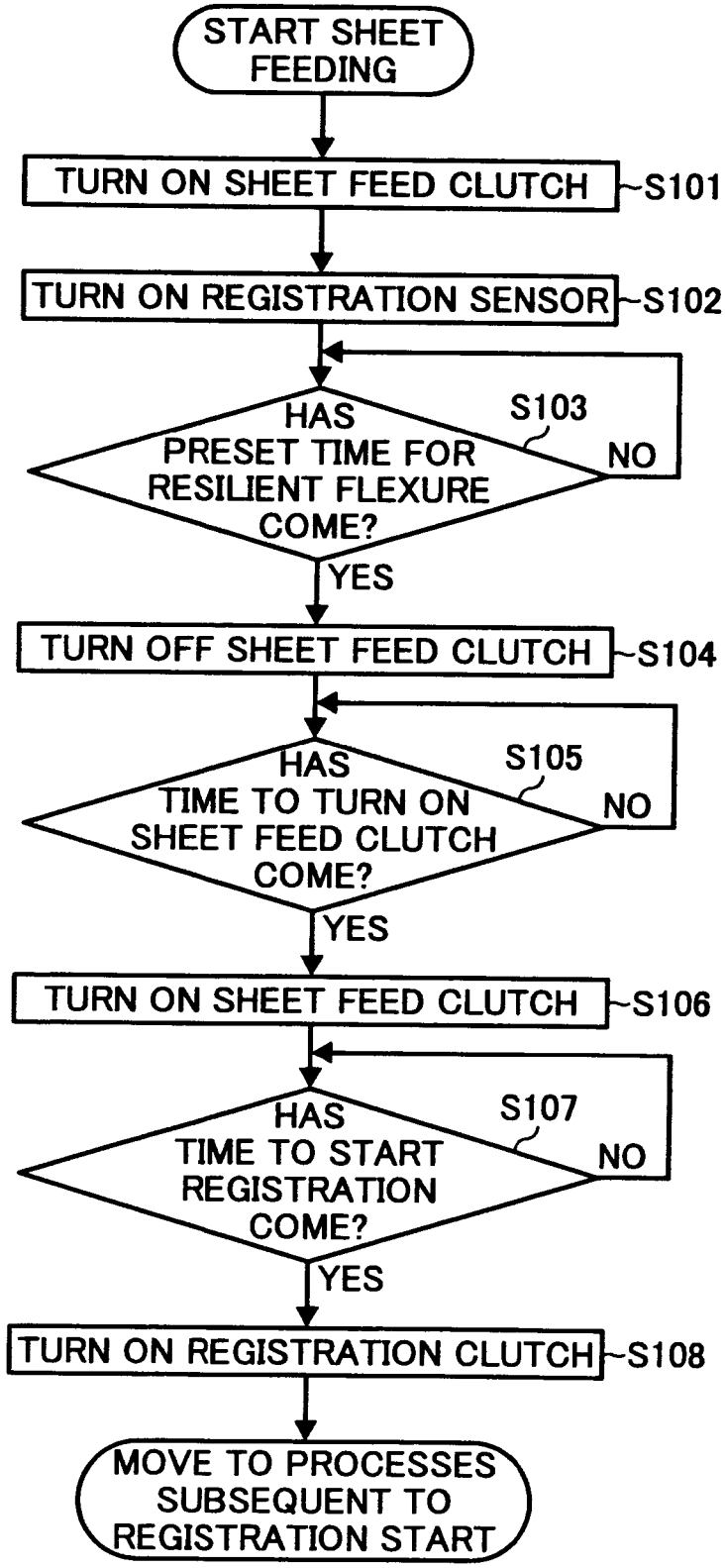
FIG. 3 is a flowchart of a sheet-conveyance control procedure according to a first embodiment of the present invention, performed in a prior-to-registration process.

FIG. 3 is a flowchart of a sheet-conveyance control procedure according to the first embodiment, performed in the prior-to-registration process.

As shown in FIG. 3, upon receipt of a print request from the main controller, the CPU 211 of the controller 210 turns on the sheet feed clutch 232 to cause the sheet feed roller 102 to convey the sheet 104 stacked on the sheet feed tray 101 toward towards the register rollers 103 (step S301). When it is necessary to select a sheet feed tray from a plurality of sheet feed trays provided in the sheet stacker 220 as shown in FIG. 2, the CPU 211 selects the sheet feed tray that contains a sheet of a size and other specification indicated by the print request, and actuates a sheet feed roller related to the sheet feed tray from which a sheet is actually to be fed.

Subsequently, the registration sensor 120 provided on the transport path extending to the register rollers 103 senses a leading edge of the sheet 104 being conveyed (step S102).

The registration sensor 120 detects the leading edge of the sheet 104 so that, upon receipt of the detection signal, the CPU 211 causes the timer provided in the RAM 901 to start time measurement for a timing at which the sheet is to be delivered to the registration standby position. Accordingly, the CPU 211 determines whether a time period set in advance for the timer as the time period after which the sheet can be resiliently flexed into contact with the register rollers 103 at the registration standby position has elapsed (step S103).

When the time period is determined to have elapsed (YES at step S103), the sheet feed clutch 232 is turned off to stop the sheet feed roller 102 (step S104). Thus, the sheet 104 is retained at the registration standby position.

The sheet 104 is maintained in this state until registration is started in timed relation to arrival of the toner image carried on the transfer belt 105 at the secondary transfer roller 116. At the instant preceding the registration starting time (YES at step S105), conveyance of the sheet 104 to the transfer position is started. According to the first embodiment, sheet conveyance is started by rotating the sheet feed roller 102 beforehand. Hence, first, the sheet feed clutch 232 is turned on to cause the sheet feed roller 102 to start rotation (step S106). When the sheet feed roller 102 is thus rotated beforehand, an appropriate degree of resilient flexure can be secured even when the degree of flexure of the sheet 104 is insufficient.

After a lapse of a predetermined period of time necessary for securing the appropriate degree of resilient flexure (YES at step S107), the registration clutch 233 is turned on to cause the register rollers 103 to start rotation, thereby starting registration (step S108). Because the appropriate degree of resilient flexure is secured at this time when registration is started, the register rollers 103 nip the sheet 104 without fail. In addition, skid of the sheet 104 that can otherwise be caused by receiving a load from the sheet feed roller 102 is prevented. Thereafter, the register rollers 103 and the sheet feed roller 102, both of which are rotating, continue conveyance of the sheet 104. This allows attaining smooth conveyance of the sheet while securing the appropriate degree of resilient flexure of the sheet.

After the registration is thus started, processing moves to the transfer process of transferring the toner image onto the sheet performed by the pair of secondary transfer rollers 107 and 116 and to the fixing process of fixing the toner image performed by the fixing unit 122.

By performing sheet conveyance in accordance with the rotating-feed-roller-beforehand control procedure shown in FIG. 3, skid of the sheet that can otherwise be caused by receiving a load from the sheet feed roller is prevented. Thus, image formation free from misregistration is attained.

The second embodiment is based on the first embodiment that employs the rotating-feed-roller-beforehand control, and devised for optimization of the sheet conveyance operations by making it possible to set the rotation-start timing of the sheet feed roller according to a sheet type that affects the degree of resilient flexure of the sheet.

According to the first embodiment, the sheet feed roller is rotated beforehand. This additionally imparts, immediately before the registration starting time, resilient flexure to the sheet that has been resiliently flexed in the registration standby state. When this control is performed on the sheet that is flexed by a sufficiently degree in the registration standby state, the sheet can be flexed by an excessive degree, thereby causing anomalous image forming or jam.

The second embodiment places its attention on the sheet type as a variable that can cause the degrees of resilient flexure of the sheet in the registration standby state to vary, and allows to perform adjustment of compensating for insufficient flexure for each sheet type while preventing excessive degree of flexure which can be caused when the sheet feed roller is rotated beforehand.

As an adjusting method according to the sheet type, a method of changing a setting on a time period after which the sheet feed roller is to be rotated beforehand (hereinafter, "beforehand-rotating period"); that is, changing a setting on a rotation-start timing of the sheet feed roller 102 to be driven beforehand, is employed. Because this method allows changing the degree of resilient flexure imparted in the prior-to-registration process, the beforehand-rotating period is set according to the sheet type to thereby obtain an appropriate degree of resilient flexure.

For example, the degree of resilient flexure in the registration standby state fluctuates depending on the stiffness of the sheet. The sheet feed roller 102 can skid on thick paper having a high stiffness (with a basis weight of 90 $g/m^2$ or higher), which results in failure in imparting resilient flexure to the sheet by the appropriate degree. On the other hand, the lower the stiffness of a sheet, by the greater degree the sheet is resiliently flexed, which makes it easier to secure an appropriate degree of resilient flexure.

Relations between the sheet types and the degrees of resilient flexure (or the level of the stiffness) are determined through experiments in advance. Based on the relations, beforehand-rotating period to be set for causing the sheet feed roller to operate appropriately is determined for each sheet type. The thus-determined time-related data are stored in an electrically erasable programmable read-only memory (EEPROM) 216 in a non-volatile memory 215 as a database in the form of a control table, or the like.

Configuring the control system as described above allows, when printing is performed, to set a beforehand-rotating period adapted to a sheet type specified by a print request based on the control data prepared in the database, thereby optimizing the sheet conveyance operations.

Figure 4:
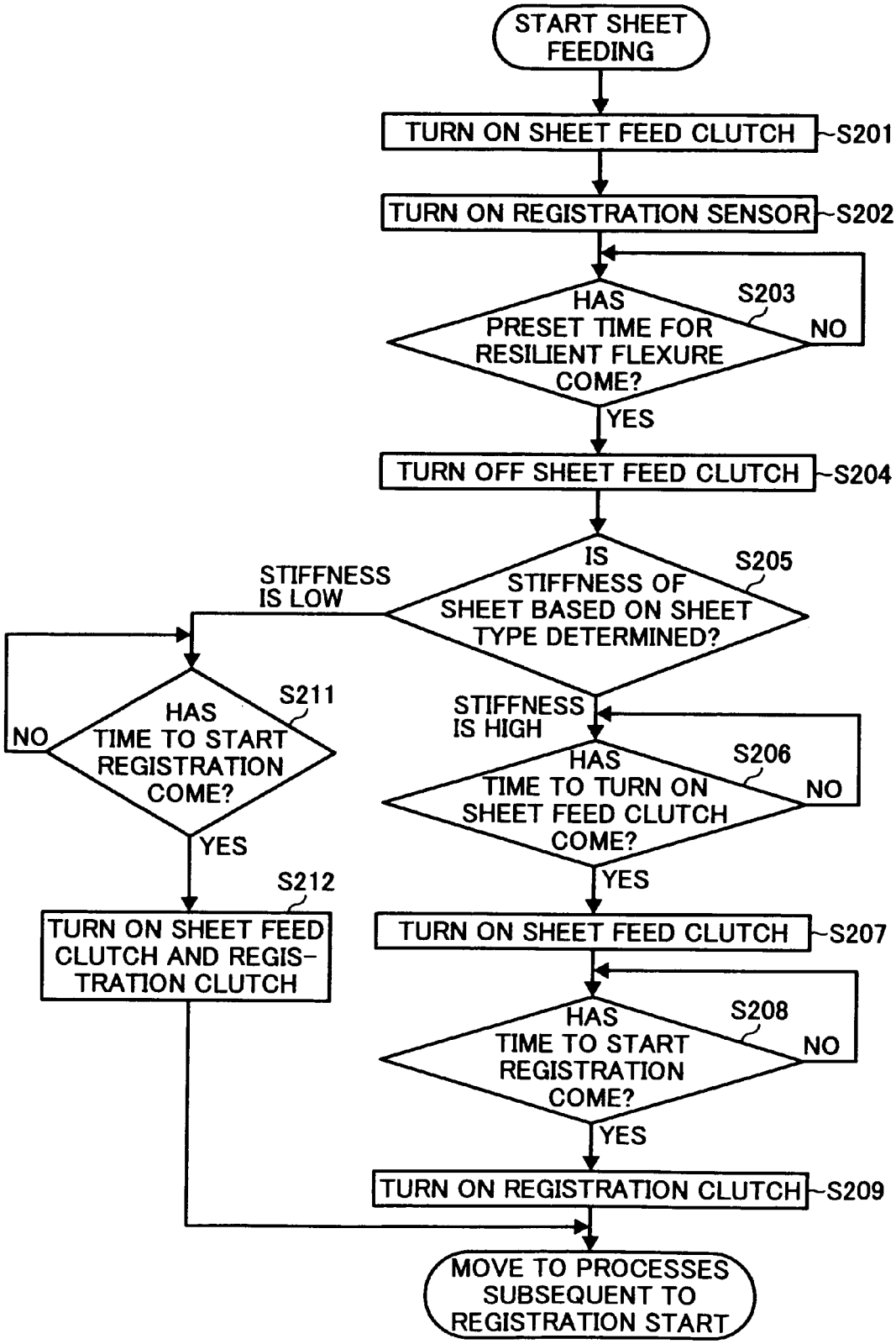
FIG. 4 is a flowchart of a sheet-conveyance control procedure according to a second embodiment of the present invention, performed in a prior-to-registration process.

FIG. 4 is a flowchart of a sheet-conveyance control procedure according to the second embodiment, performed in the prior-to-registration process.

The control procedure shown in FIG. 4 is an example in which the procedure is bifurcated into two routes according to the level of the sheet stiffness. One of the routes is for sheets having lower stiffness and therefore securing an enough degree of resilient flexure without rotating the sheet feed roller beforehand.

With reference to the control procedure shown in FIG. 4, upon receipt of a print request from the main controller, as in the case of the control procedure shown in FIG. 3, the CPU 211 of the controller 210 turns on the sheet feed clutch 232 to cause the sheet feed roller 102 to convey the sheet 104 stacked on the sheet feed tray 101 toward the register rollers 103 (step S201). When it its necessary to select a sheet feed tray from a plurality of sheet feed trays provided in the sheet stacker 220 as shown in FIG. 2, the CPU 211 must select the sheet feed tray that contains a sheet of a size, a sheet type, and other specification indicated by the print request, and actuate a sheet feed roller related to the sheet feed tray from which a sheet is actually to be fed.

Subsequently, the registration sensor 120 provided on the transport path extending to the register rollers 103 senses a leading edge of the sheet 104 being conveyed (step S202).

The registration sensor 120 detects the leading edge of the sheet 104 so that, upon receipt of the detection signal, the CPU 211 causes the timer provided in the RAM 901 to start time measurement for a timing at which the sheet is to be delivered to the registration standby position. Accordingly, the CPU 211 determines whether a time period set in advance for the timer as the time period after which the sheet can be resiliently flexed into contact with the register rollers 103 at the registration standby position has elapsed (step S203).

When the time period is determined to have elapsed (YES at step S203), the sheet feed clutch 232 is turned off to stop the sheet feed roller 102 (step S204). Thus, the sheet 104 is retained at the registration standby position.

The sheet 104 is maintained in this state until registration is started in timed relation to arrival of the toner image carried on the transfer belt 105 at the secondary transfer roller 116. At the instant when the registration starting time has come, conveyance of the sheet 104 to the transfer position is started.

Meanwhile, according to the second embodiment, because a sheet is subjected to one of different conveyance operations according to the sheet type, determination of a sheet type is performed prior to the start of registration (step S205). Information on the sheet type can be obtained from data indicated in conjunction with the print request. When the print request is entered through an operating panel (not shown) by a user, the CPU 211 interprets the input data entered with a key, or the like. When the print request is entered through a network interface (I/F) or the like from an external host machine, the CPU 211 obtains information on the sheet type from a command contained in print data. The sheet type is determined by classifying a sheet into either a stiffness-high group or a stiffness-low group by referring to the database having been prepared in advance. In conjunction with the classification, the beforehand-rotating period for the sheet feed roller, with which appropriate operation of the sheet feed roller is attained, is fetched from the database.

When a sheet is classified into the stiffness-low group as a result of determination about the stiffness of the sheet, the sheet is estimated to be resiliently flexed enough to perform normal operations. Based on the estimation, rotating-feed-roller-beforehand control is skipped, and the sheet is maintained at the registration standby position until registration is started in timed relation with arrival of the toner image at the secondary transfer roller 116. At the instant when the registration starting time has come (YES at step S211), the sheet feed clutch 232 and the registration clutch 233 are turned on to cause both the sheet feed roller 102 and the register rollers 103 to start rotation, thereby stating registration (step S212).

On the other hand, when a sheet is classified into the stiffness-high group, the sheet is estimated to be resiliently flexed insufficiently to perform normal operations. Based on the estimation, the prior-to-registration process is started by rotating the sheet feed roller beforehand. At the instant preceding the registration starting time (YES at step S206), first, the sheet feed clutch 232 is turned on to cause the sheet feed roller 102 to start rotation (step S207). Thus rotating the sheet feed roller 102 beforehand allows to secure an appropriate degree of resilient flexure even when the degree of flexure of the sheet 104 is insufficient.

After a lapse of a predetermined period of time necessary for securing the appropriate degree of resilient flexure (YES at step S208), the registration clutch 233 is turned on to cause the register rollers 103 to start rotation, thereby starting registration (step S209). Because the appropriate degree of resilient flexure is secured at this time when registration is started, the register rollers 103 nip the sheet 104 without fail. In addition, skid of the sheet 104 that can otherwise be caused by receiving a load from the sheet feed roller 102 is prevented. Thereafter, the register rollers 103 and the sheet feed roller 102, both of which are rotating, continue conveyance of the sheet 104. This allows attaining smooth conveyance of the sheet while securing the appropriate degree of resilient flexure of the sheet.

In any one of the process of rotating the sheet feed roller beforehand and the process of not rotating the sheet feed roller beforehand, after completion of the prior-to-registration process, subsequent processes thereto are performed. Specifically, the toner image is transferred onto the sheet by the pair of secondary transfer rollers 107 and 116, and thereafter the toner image is fixed on the sheet by the fixing unit 122.

By performing the control procedure that allows to select the rotating-feed-roller-beforehand control depending on a sheet type, jamming of the sheet, which can be caused by an excessive degree of resilient flexure, and misregistration due to skid of the sheet, which can be caused by an insufficient degree of resilient flexure, can be prevented.

The second embodiment has described an example in which the number of the sheet types to be used in the rotating-feed-roller-beforehand control is one. Alternatively, even in a mode adapted to a plurality of sheet types, the same procedure can be implemented by branching the procedure depending on a result of sheet type determination.

The third embodiment is based on the second embodiment in which whether the rotating-feed-roller-beforehand control is to be performed is determined based on the sheet type, and devised for optimization of the sheet conveyance operations by making it possible to set the rotation-start timing of the sheet feed roller according to a temperature and humidity that affect the degree of resilient flexure of the sheet.

While the second embodiment places its attention on the sheet type as a variable that can cause the degrees of resilient flexure of the sheet in the registration standby state to vary, the third embodiment places its attention on the temperature and humidity as another variable, and allows to perform adjustment of compensating for insufficient flexure according to the sheet type and the temperature/humidity while preventing excessive degree of resilient flexure which can be caused by rotating the sheet feed roller beforehand.

The degree of resilient flexure fluctuates depending on the stiffness of the sheet. Hence, a method of changing the beforehand-rotating period of the sheet feed roller is employed. In other words, a method of changing the setting for the rotation-start timing of the sheet feed roller 102 to be driven beforehand according to the stiffness of the sheet is employed as in the case of the second embodiment.

However, according to the third embodiment, the level of the sheet stiffness must be determined based on the sheet type with consideration given to the temperature and humidity. The relations of the degree of resilient flexure (or the level of the stiffness) in the registration standby state with respect to the sheet type, and the temperature and humidity are experimentally determined in advance. The thus-determined data are added to the database, which has been described according to the second embodiment, which defines the relations between the beforehand-rotating periods and the level of the sheet stiffness with each of which appropriate operation is attained. The database is stored in the EEPROM 216 in the non-volatile memory 215. The image forming apparatus must be provided with means for obtaining data on environmental temperature and humidity of the apparatus.

When the control system is configured according to these conditions, when printing is performed, the beforehand-rotating period adapted to the sheet type, and the temperature and humidity specified by a print request can be set based on the control data prepared in the database, thereby optimizing the sheet conveyance operations.

Figure 5:
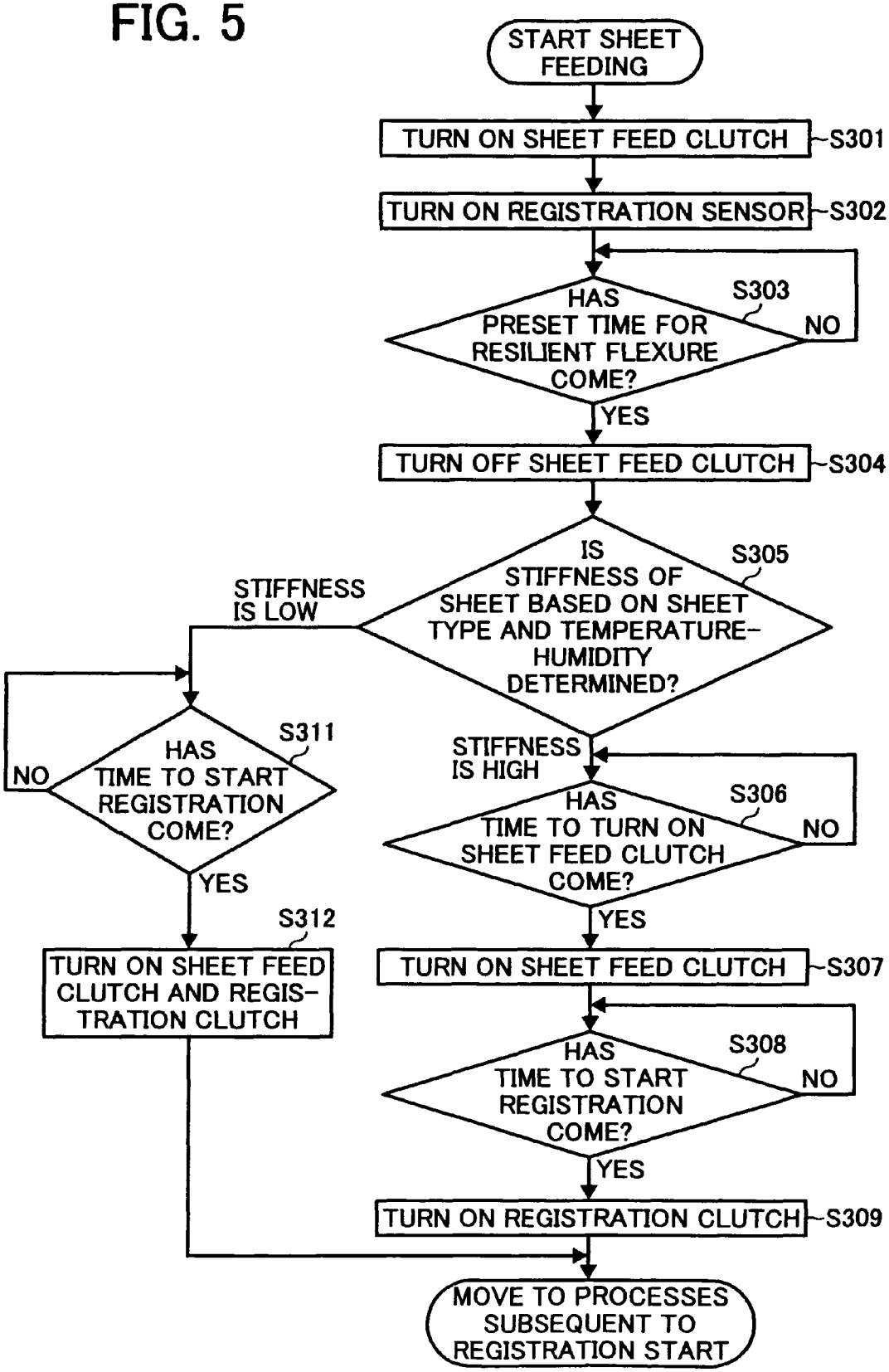
FIG. 5 is a flowchart of a sheet-conveyance control procedure according to a third embodiment of the present invention, performed in a prior-to-registration process.

FIG. 5 is a flowchart of a sheet-conveyance control procedure according to the third embodiment, performed in the prior-to-registration process.

The control procedure shown in FIG. 5 is an example in which the control processes are bifurcated into two routes according to the level of the sheet stiffness. One of the routes is for sheets that have lower stiffness and therefore allows to secure enough degrees of flexure even when the sheet feed roller is not rotated beforehand. In the control procedure, basically the same procedure as that performed according to the second embodiment is performed.

Meanwhile, according to the third embodiment, as described above, the control procedure is branched in accordance with the level of the sheet stiffness that is determined based on the sheet type with consideration given to the temperature and the humidity. Hence, a process of making this determination is required.

In the control procedure shown in FIG. 5, the determining is made at step S305. The determining step is performed at branching of the control procedure before registration is started in a state where the sheet 104 is stopped at the registration standby position (after completion of the process pertaining to step S304).

As in the case of the second embodiment, information on the sheet type necessary for determining the sheet stiffness is obtained from data indicated in conjunction with the print request. Information on the temperature and humidity can be obtained from data sensed by a sensor provided in the apparatus. Whether the sheet is classified into the stiffness-high group or the stiffness-low group is determined based on the thus-obtained information on the sheet type and the temperature and humidity by referring to the database having been prepared in advance. In conjunction with the classification, the beforehand-rotating period for the sheet feed roller, with which appropriate operation of the sheet feed roller is attained, is fetched from the database.

When a sheet is classified into the stiffness-low group, the sheet is estimated to be resiliently flexed enough to perform normal operations at the registration standby position. Based on the estimation, the sheet feed roller is not rotated beforehand. On the other hand, when a sheet is classified into the stiffness-high group, the sheet is estimated not to be resiliently flexed insufficiently to perform normal operations. Based on the estimation, the sheet feed roller is rotated beforehand in the prior-to-registration process.

The control procedure shown in FIG. 5 is identical with the control procedure described according to the second embodiment with reference to FIG. 4 in a range from the start of the control procedure to arrival at the registration standby position (steps S301 to S304), and the prior-to-registration process where the control procedure is branched (steps S306 to S309, steps S311 and S312), except for determining the level of the sheet stiffness performed in the process pertaining to step S305. Hence, descriptions on the control procedure shown in FIG. 5, which can be referred to those of the second embodiment, are omitted.

By performing the control procedure (FIG. 5) that allows to select the rotating-feed-roller-beforehand control according to the sheet type, and the temperature and humidity, jamming of the sheet, which can be caused by an excessive degree of resilient flexure, and misregistration due to skid of the sheet, which can be caused by an insufficient degree of resilient flexure, can be more reliably prevented.

The third embodiment has described an example in which the number of conditions related to the sheet types, and the temperature and humidity to be used in the rotating-feed-roller-beforehand control is one. Alternatively, even in a mode adapted to a plurality of conditions, the same procedure can be implemented by branching the procedure depending on a result of determination as to whether a condition needs the rotating-feed-roller-beforehand control.

The fourth embodiment is based on the first embodiment in which the sheet feed roller is rotated beforehand, and devised for optimization of the sheet conveyance operations by making it possible to set the rotation-start timing of the sheet feed roller according to a type of the sheet feed roller that affects the degree of resilient flexure of the sheet.

According to the first embodiment, the sheet feed roller is rotated beforehand, thereby additionally imparting, immediately before the registration starting time, resilient flexure to the sheet that has been resiliently flexed in the registration standby state. When this control is performed on the sheet that is resiliently flexed by a sufficiently degree in the registration standby state, the sheet can be resiliently flexed by an excessive degree, which can cause anomalous image forming or jam.

The fourth embodiment places its attention on the type of the sheet feed roller as another variable that can cause the degrees of resilient flexure of the sheet in the registration standby state to vary, and allows to perform adjustment of compensating for insufficient flexure for each type of the sheet feed roller while preventing excessive degree of flexure which can be caused when the sheet feed roller is rotated beforehand. According to the fourth embodiment, it is assumed that a difference between sheet feed rollers (which differ from one another in mechanical configurations) manifests itself in the form of a difference in conveyance force, and hence a cause-and-effect relation is built between the type of the sheet feed rollers and the degree of the resilient flexure.

As an adjusting method according to the conveyance force (the type of the sheet feed roller), a method of changing a setting on the beforehand-rotating period; that is, changing a setting on a rotation-start timing of the sheet feed roller 102 to be driven beforehand, is employed. Because this method allows to change the degree of resilient flexure imparted in the prior-to-registration process, the beforehand-rotating period is set according to the conveyance force to thereby obtain an appropriate degree of resilient flexure.

The sheet conveyance force differs from one sheet feed roller to another depending on the mechanical configuration such as a material of the roller; in other words, the type of the sheet feed roller. For example, in the apparatus shown in FIG. 1, the conveyance force of the double-sided printing rollers 119 serving as the sheet feed roller for printing on the second side is smaller than that of the sheet feed roller 102. Accordingly, the double-sided printing rollers 119 are incapable of imparting an appropriate degree of resilient flexure to a sheet. Hence, when the beforehand-rotating period for the first side and that for the second side are set based on a same condition, a problem can occur. Meanwhile, the apparatus can include, other than the roller for use in the double-sided printing, another sheet feed roller for use in another sheet feed port, such as a manual sheet-feed port.

Relations between the types of the sheet feed roller and the degrees of resilient flexure are determined through experiments in advance. Based on the relations, a beforehand-rotating period to be set for causing the sheet feed roller to operate appropriately is determined for each type of the sheet feed roller. The thus-determined time-related data are stored in the EEPROM 216 in non-volatile memory 215 as a database in the form of a control table, or the like.

Configuring the control system as described above allows, when printing is performed, to set the beforehand-rotating period adapted to the type of the sheet feed roller based on the control data prepared in the database, thereby optimizing the sheet conveyance operations. The type of the sheet feed roller can be known from information indicated in a print request, a device condition sensed by a sensor provided in the device, or the like.

Figure 6:
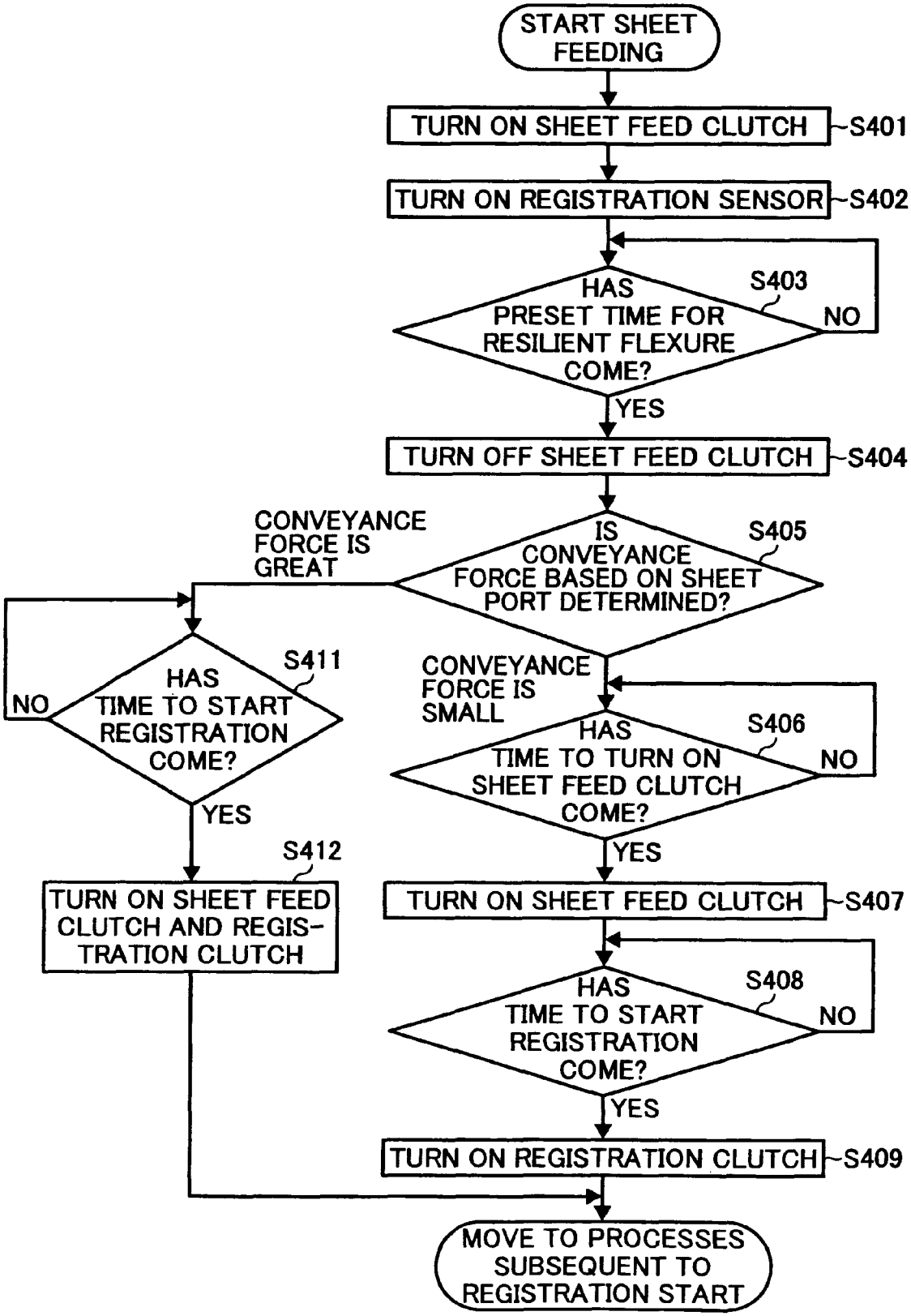
FIG. 6 is a flowchart of a sheet-conveyance control procedure according to a fourth embodiment of the present invention, performed in a prior-to-registration process.

FIG. 6 is a flowchart of a sheet-conveyance control procedure according to the fourth embodiment, performed in the prior-to-registration process.

The control procedure shown in FIG. 6 is an example in which the processes are bifurcated into two routes according to the magnitude of the conveyance force. One of the routes is for a sheet feed roller that has a greater conveyance force and therefore allows to secure an enough degree of resilient flexure even when the sheet feed roller is not rotated beforehand.

With reference to the control procedure shown in FIG. 6, upon receipt of a print request from the main controller (not shown), the CPU 211 of the controller 210 first turns on the sheet feed clutch 232 to cause the sheet feed roller 102 to convey the sheet 104 stacked on the sheet feed tray 101 toward the register rollers 103 (step S401). When it its necessary to select a sheet feed tray from a plurality of sheet feed trays provided in the sheet stacker 220 as shown in FIG. 2 or when it is necessary to select a sheet feed port for use in printing on the second side in double-sided printing, the CPU 211 must select and actuate the sheet feed port through which a sheet is actually to be fed.

Subsequently, the registration sensor 120 provided on the transport path extending to the register rollers 103 senses a leading edge of the sheet 104 being conveyed (step S402).

The registration sensor 120 detects the leading edge of the sheet 104 so that, upon receipt of the detection signal, the CPU 211 causes the timer provided in the RAM 901 to start time measurement for a timing at which the sheet is to be delivered to the registration standby position. Accordingly, the CPU 211 determines whether a time period set in advance for the timer as the time period after which the sheet is resiliently flexed into contact with the register rollers 103 at the registration standby position has elapsed (step S403).

When the time period is determined to have elapsed (YES at step S403), the sheet feed clutch 232 is turned off to stop the sheet feed roller 102 (step S404). Thus, the sheet 104 is retained at the registration standby position.

The sheet 104 is maintained in this state until registration is started in timed relation to arrival of the toner image carried on the transfer belt 105 at the secondary transfer roller 116. At the instant when the registration starting time has come, conveyance of the sheet 104 to the transfer position is started.

Meanwhile, according to the fourth embodiment, because a sheet is subjected to one of separate conveyance operations according to the type of the sheet feed roller (sheet feed port), determination of the type of the sheet feed roller (sheet feed port) is performed prior to the start of registration (step S405). Information on the type of the sheet feed roller (sheet feed port) can be obtained from data indicated in conjunction with the print request, an operating condition of the device during printing on the second side in double-sided printing, and the like. The type of the sheet feed roller (sheet feed port) is determined by classifying a sheet feed roller into either a great conveyance-force group or a small conveyance-force group by referring to the database prepared in advance. In conjunction with the classification, the beforehand-rotating period to be set for causing the sheet feed roller to operate appropriately is fetched from the database.

When a sheet is classified into the great conveyance-force group as a result of the determination on the conveyance force of the sheet feed roller, the sheet is estimated to be resiliently flexed enough to perform normal operations. Based on the estimation, rotating the sheet feed roller beforehand is skipped, and the sheet is maintained at the registration standby position until registration is started in timed relation to arrival of the toner image at the secondary transfer roller 116. At the instant when the registration starting time has come (YES at step S411), the sheet feed clutch 232 and the registration clutch 233 are turned on to cause both the sheet feed roller 102 and the register rollers 103 to start rotation, thereby stating registration (step S412).

On the other hand, when a sheet is classified into the small conveyance-force group, the sheet is estimated to be resiliently flexed insufficiently to perform normal operations. Based on the estimation, the prior-to-registration process is started by rotating the sheet feed roller beforehand. At the instant preceding the registration starting time (YES at step S406), first, the sheet feed clutch 232 is turned on to cause the sheet feed roller 102 to start rotation (step S407). When the sheet feed roller 102 is thus rotated beforehand, an appropriate degree of resilient flexure can be secured even when the degree of flexure of the sheet 104 is insufficient.

After a lapse of a predetermined period of time necessary for securing the appropriate degree of resilient flexure (YES at step S408), the registration clutch 233 is turned on to cause the register rollers 103 to start rotation, thereby starting registration (step S409). Because the appropriate degree of resilient flexure is secured at this time when registration is started, the register rollers 103 nip the sheet 104 without fail. In addition, skid of the sheet 104 that can otherwise be caused by receiving a load from the sheet feed roller 102 is prevented. Thereafter, the register rollers 103 and the sheet feed roller 102, both of which are rotating, continue conveyance of the sheet 104. This allows to attain smooth conveyance of the sheet while securing the appropriate degree of resilient flexure of the sheet.

In each of the process of rotating the sheet feed roller beforehand and the process of not rotating the sheet feed roller beforehand, after completion of the prior-to-registration process, processing moves to the transfer process performed by the pair of secondary transfer rollers 107 and 116 of transferring the toner image onto the sheet, and further to the fixing process performed by the fixing unit 122 of fixing the toner image on the sheet.

By performing the control procedure that allows to select the rotating-feed-roller-beforehand control depending on the type of the sheet feed roller (sheet feed port), jamming of the sheet, which can be caused by an excessive degree of resilient flexure, and misregistration due to skid of the sheet, which can be caused by an insufficient degree of resilient flexure, can be prevented.

The fourth embodiment has described an example in which the number of the types of the sheet feed roller to be used in the rotating-feed-roller-beforehand control is one. Alternatively, even in a mode adapted to a plurality of types of the sheet feed roller (sheet feed ports), the same procedure can be implemented by branching the procedure depending on a result of sheet type determination.

The fifth embodiment is based on the fourth embodiment in which the sheet feed roller is rotated beforehand according to the type of the sheet feed roller, and devised for optimization of the sheet conveyance operations by making it possible to set the rotation-start timing of the sheet feed roller according to time-varying change of the sheet feed roller that affects the degree of resilient flexure of the sheet as well.

While the second embodiment places its attention on the sheet type as a variable that can cause the degrees of resilient flexure of the sheet in the registration standby state to vary, the fifth embodiment places its attention on the time-varying change of the sheet feed roller, such as wear on a roller working surface, as another variable, and allows to perform adjustment of compensating for insufficient flexure for each sheet type and the time-varying change of the sheet feed roller while preventing excessive degree of flexure which can be caused when the sheet feed roller is rotated beforehand.

The degree of resilient flexure fluctuates when the conveyance force decreases due to wear on the roller working surface. Hence, as a method of performing adjustment according to the sheet type, changing the setting for the beforehand-rotating period; that is, changing the setting for the rotation-start timing of the sheet feed roller 102 to be driven beforehand, is employed. The fifth embodiment is identical with the fourth embodiment on this regard.

Meanwhile, according to the fifth embodiment, the magnitude of the conveyance force must be determined based on the type of the sheet feed roller with consideration given to the wear on the roller working surface. Hence, the relations of the degree of resilient flexure (or the magnitude of the conveyance force) in the registration standby state with respect to the sheet type and the wear of a roller working surface corresponding to the time-varying change are determined through experiments in advance. The thus-determined data are added to the database, which has been described according to the fourth embodiment, that defines the relation between the type of the sheet feed roller and the beforehand-rotating period to be set for causing the sheet feed roller to operate appropriately for each feed roller type. The database is stored in the EEPROM 216 in the non-volatile memory 215. The data indicating the wear condition on the working surface of the roller corresponding to the time-varying change is obtained as, for example, the number of prints having been printed with the roller (i.e., after replacement to the roller) maintained as data related to the sheet feed roller. Hence, the fifth embodiment can be implemented when a unit for obtaining the data is provided.

Configuring the control system according to these conditions allows, when printing is performed, to set the beforehand-rotating period adapted to the type of the sheet feed roller and the time-varying change of the roller indicated in a print request based on the control data prepared in the database, thereby optimizing the sheet conveyance operations.

Figure 7:
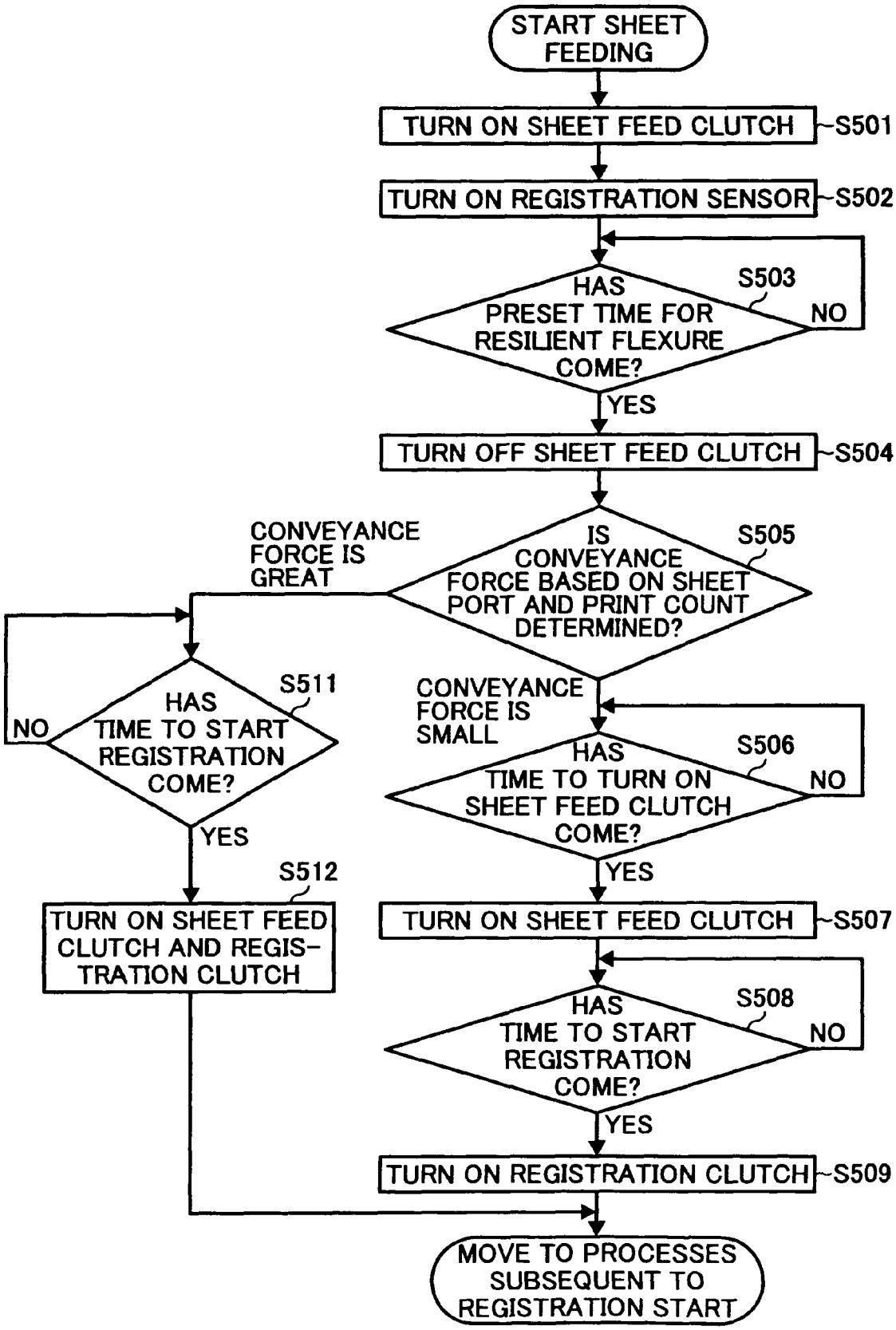
FIG. 7 is a flowchart of a sheet-conveyance control procedure according to a fifth embodiment of the present invention, performed in a prior-to-registration process.

FIG. 7 is a flowchart of a sheet-conveyance control procedure according to the fifth embodiment, performed in the prior-to-registration process.

The control procedure shown in FIG. 7 is an example in which the control procedure is bifurcated into two routes according to the magnitude of the conveyance force. One of the routes is for a sheet feed roller that has a greater conveyance force and therefore allows to secure an enough degree of resilient flexure even when the sheet feed roller is not rotated beforehand. In the control procedure, basically the same procedure as that performed according to the fourth embodiment (FIG. 6) is performed.

Meanwhile, according to the fifth embodiment, as described above, the control procedure is branched in accordance with the magnitude of the conveyance force is determined based on the type of the sheet feed roller with consideration given to the time-varying change of the roller (the number of prints printed with the roller). Hence, a process of making this determination is required.

In the control procedure shown in FIG. 7, the determining is made at step S505. The determining step is performed at branching of the control procedure before registration is started in a state where the sheet 104 is stopped at the registration standby position (after completion of the process pertaining to step S504).

Information on the type of the sheet feed roller that is necessary for determining the magnitude of the conveyance force is obtained from, as in the case of the fourth embodiment, data indicated in conjunction with the print request, data indicating an operating condition of the device, and the like. Information on the time-varying change of the roller can be obtained from management data on the device. Whether the sheet is classified into the stiffness-high group or the great conveyance-force group or the small conveyance-force group is determined based on the thus-obtained information on the type of the sheet feed roller and the time-varying change of the roller by referring to the database having been prepared in advance. In conjunction with the classification, the beforehand-rotating period to be set for causing the sheet feed roller to operate appropriately, is fetched from the database.

When a sheet is classified into the great conveyance-force group as a result of the determination on the magnitude of the conveyance force, the sheet is estimated to be resiliently flexed enough to perform normal operations at the registration standby position. Based on the estimation, the sheet feed roller is not rotated beforehand. On the other hand, when a sheet is classified into the small conveyance-force group, the sheet is estimated to be resiliently flexed insufficiently to perform normal operations. Based on the estimation, the prior-to-registration process is started by rotating the sheet feed roller beforehand.

The control procedure shown in FIG. 7 is identical with the control procedure described according to the fourth embodiment with reference to FIG. 6 in a range from the start of the control procedure to arrival at the registration standby position (steps S501 to S504), and the prior-to-registration process where the control procedure is branched (steps S506 to S509, steps S511 and S512), except for determining the magnitude of the conveyance force performed in the process pertaining to step S505. Hence, descriptions on the control procedure shown in FIG. 7, which can be referred to those of the fourth embodiment, are omitted.

By performing the control procedure (FIG. 7) that allows to select the rotating-feed-roller-beforehand control depending on a type of the sheet feed roller and the time-varying change of the roller, jamming of the sheet, which can be caused by an excessive degree of resilient flexure, and misregistration due to skid of the sheet, which can be caused by an insufficient degree of resilient flexure, can be more reliably prevented.

The fifth embodiment has described an example in which the number of conditions related to the type of the sheet feed roller and the time-varying change of the roller to be used in the rotating-feed-roller-beforehand control is one. Alternatively, even in a mode adapted to a plurality of conditions, the same procedure can be implemented by branching the procedure depending on a result of determination as to whether a condition needs the rotating-feed-roller-beforehand control.

The sixth embodiment is based on such an embodiment as described in the second to fifth embodiments that allows to set the rotation-start timing according to with the sheet type, the combination of the sheet type and the temperature and humidity, the type of the sheet feed roller, and the combination of the type of the sheet feed roller and the time-varying changes of the sheet feed roller, each affecting the degree of resilient flexure of the sheet, and rotate the sheet feed roller beforehand. The sixth embodiment is devised for optimization of the sheet conveyance operations by further including the inter-device-difference compensation.

The relations, to which attentions are placed in the second to fifth embodiments, between the degrees of resilient flexure and variables therefore are obtained under standard conditions. Hence, an error (inter-device-difference) is developed among devices (machines), which can make it difficult to obtain desirable results.

To this end, the sixth embodiment includes a unit that compensates for the inter-device-difference, thereby permitting optimization of the sheet conveyance operations on a machine-by-machine basis.

According to the sixth embodiment, the beforehand-rotating period of the sheet feed roller, which is set for changing the degree of resilient flexure imparted in the prior-to-registration process, is adjusted so that variation of the degree of resilient flexure due to an inter-device difference is compensated, thereby attaining optimization. In each of the second to fifth embodiments, the beforehand-rotating period of the sheet feed roller is determined based on setting data obtained under standard conditions. The sixth embodiment can be implemented by, e.g., manually correcting the setting data on a machine-by-machine basis via the operating panel. More specifically, in the configurations of the second to fifth embodiments, inter-device-difference compensating values are managed related to the database, in which the relations about the beforehand-rotating periods are defined, so that the compensating values can be used in compensation for the setting data in the database.

Configuring the control system according to these conditions allows, when printing is performed, to set the beforehand-rotating period of the sheet feed roller adapted to the sheet type, the combination of the sheet type and the temperature and humidity, the type of the sheet feed roller, and the combination of the type of the sheet feed roller and the time-varying change of the sheet feed roller, each affecting the degree of resilient flexure of the sheet based on the control data prepared in the database and the inter-device-difference compensating values maintained in the form of related to the database, thereby optimizing the sheet conveyance operations.

Figure 8:
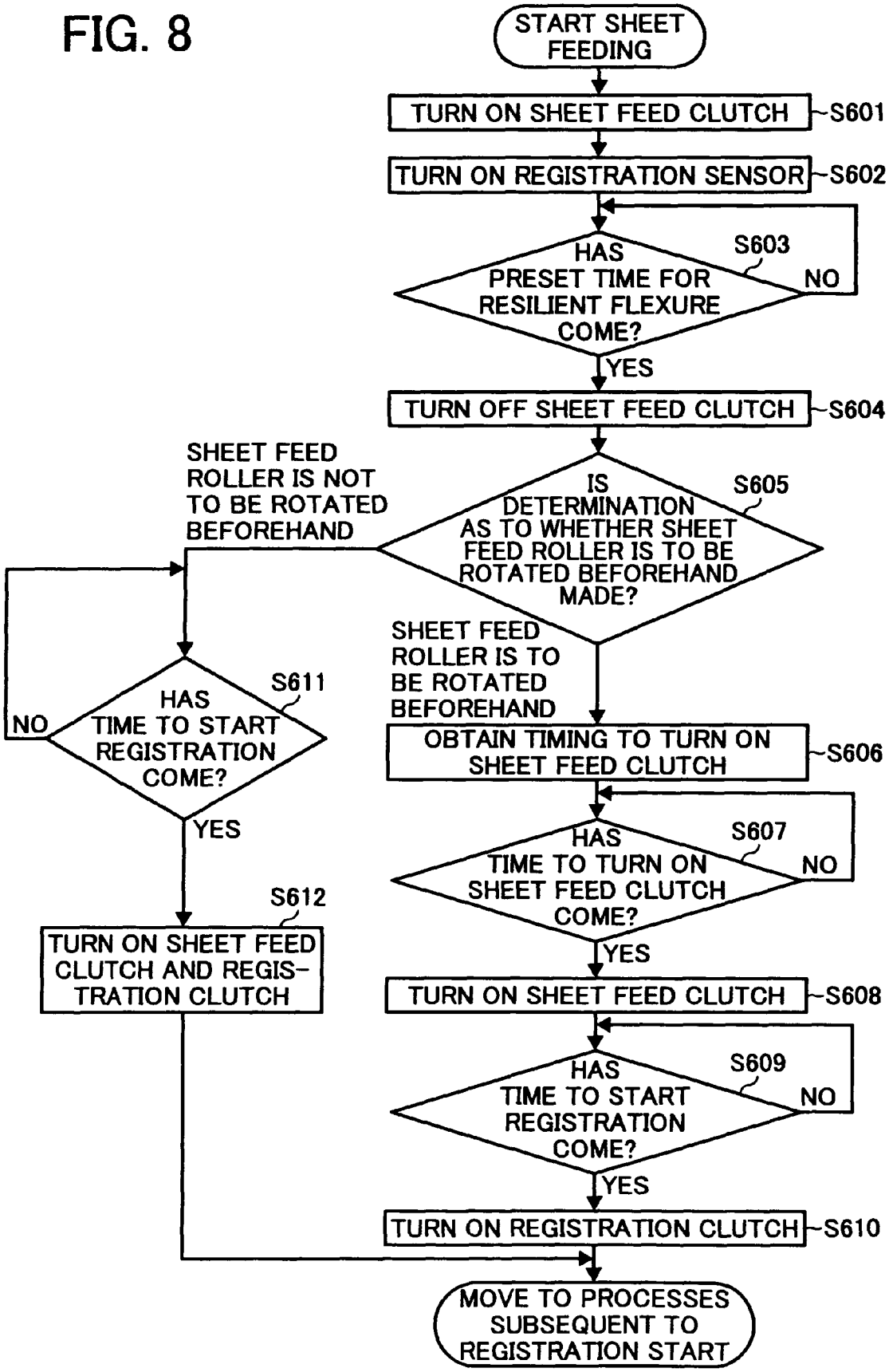
FIG. 8 is a flowchart of a sheet-conveyance control procedure according to a sixth embodiment of the present invention, performed in a prior-to-registration process.
Figure 9:
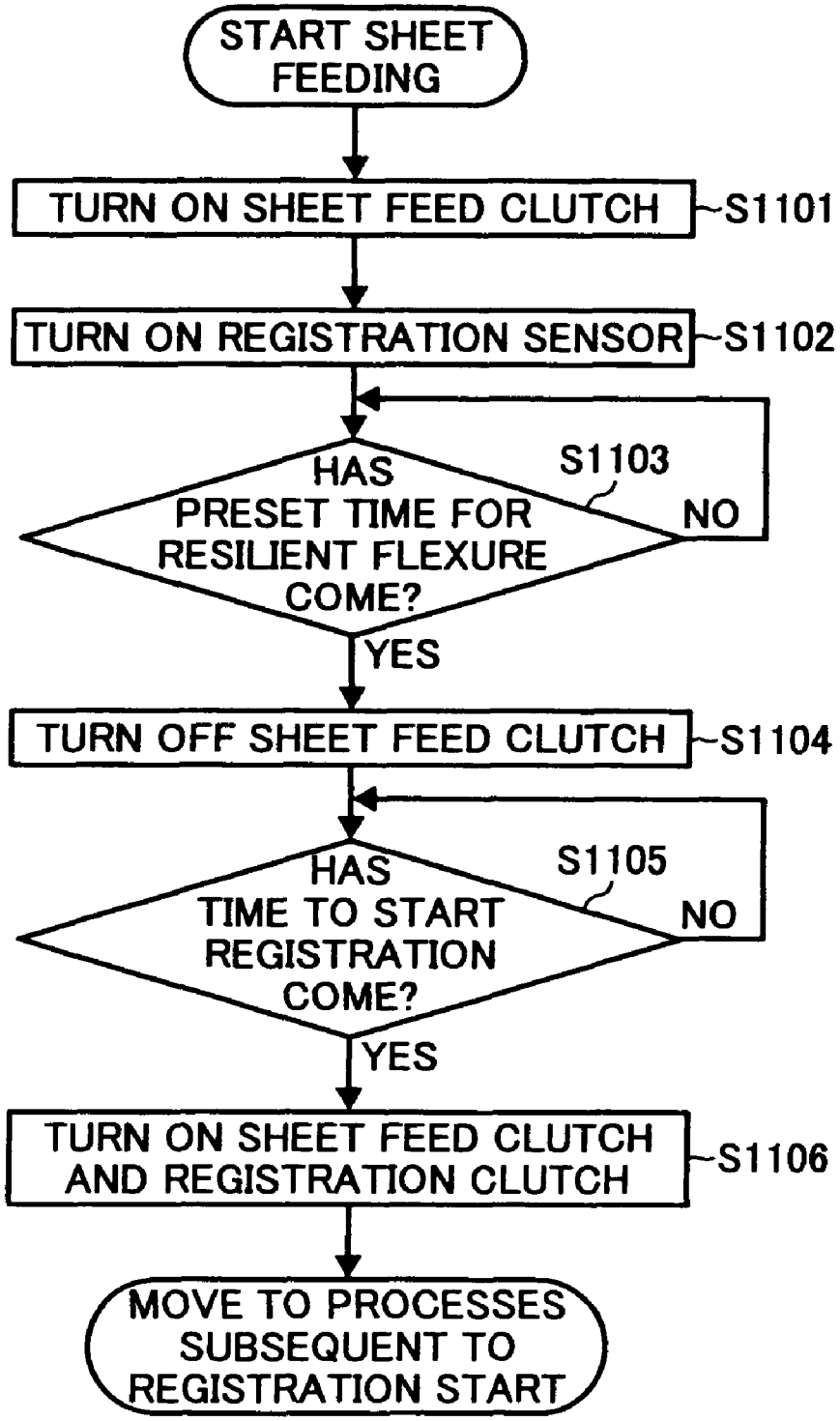
FIG. 9 is a flowchart of a conventional sheet-conveyance control procedure performed in a prior-to-registration process.

FIG. 8 is a flowchart of a sheet-conveyance control procedure according to the sixth embodiment, performed in the prior-to-registration process.

The control procedure shown in FIG. 8 is an example in which the control processes are bifurcated into two routes according to whether the sheet feed roller is rotated beforehand. One of the routes referred to as "Sheet feed roller is rotated beforehand" is a route for a sheet that can be resiliently flexed by an appropriate degree without rotating the sheet feed roller beforehand. For the route, the same control procedure as that performed in the second to fifth embodiments (FIGS. 4 to 7) at the processes corresponding to steps S611 and S612 is basically performed.

Meanwhile, according to the sixth embodiment, as described above, the control procedure is branched based on a determination as to whether the rotating-feed-roller-beforehand control is to be performed after compensation for the inter-device-difference. Hence, the sixth embodiment must include a process of making this determination.

In the control procedure shown in FIG. 8, the determining is made at step S605. The determining step is performed at branching of the control procedure before registration is started in a state where the sheet 104 is stopped at the registration standby position (after completion of the process pertaining to step S604).

The determination as to whether the rotating-feed-roller-beforehand control is to be performed is made at the steps S205, S305, S405, and S505 of the corresponding control procedures (FIGS. 4 to 7) of the second to fifth embodiments. When it is determined that the rotating-feed-roller-beforehand control is to be performed, the beforehand-rotating period is compensated for the inter-device-difference, and thereafter a value to be set to the subsequent rotating-feed-roller-beforehand control process is obtained.

Hence, in the control procedure, the set value for the beforehand-rotating period having been compensated for the inter-device-difference is obtained (step S606), and at the timing determined by the thus-obtained set value (step S607), the sheet feed clutch 232 is turned on (step S608). When the beforehand-rotating control of the sheet feed roller is performed at the instant preceding the registration starting time while performing the inter-device-difference compensation, even when the degree of flexure of the sheet 104 is insufficient, an appropriate degree of resilient flexure can be secured.

The control procedure shown in FIG. 8 is identical with the control procedures described in the second to fifth embodiments with reference to FIGS. 4 to 7 in a range from the start of the control procedure to arrival at the registration standby position (steps S601 to S604). Hence, descriptions on the control procedure of the sixth embodiment, which can be referred to those of the second to fifth embodiments, are omitted.

By performing the control procedure (FIG. 8) in which the beforehand-rotating timing of the sheet feed roller is compensated for the inter-device-difference, jamming of the sheet, which can be caused by an excessive degree of resilient flexure, and misregistration due to skid of the sheet, which can be caused by an insufficient degree of resilient flexure, are prevented on a machine-by-machine basis.

As described above, according to one aspect of the present invention, even when the degree of resilient flexure of a sheet at the registration standby position is small and can cause skid of the sheet according to the conventional technique, the degree of resilient flexure can be increased by actuating the sheet feed roller beforehand. Hence, timing between arrival of the toner image carried on the image carrier (the photoconductor, the intermediate transfer belt) at the transfer position and sheet feeding is synchronized, thereby allowing to perform appropriate sheet conveyance operations. In addition, because no specific unit is required in the hardware configuration, restrictions on the structure of the apparatus can be minimized.

By setting the rotation-start timing of the sheet feed roller according to the sheet type, the combination of the sheet type and the temperature and humidity, the type of the sheet feed roller, and the combination of the type of the sheet feed roller and the time-varying changes of the sheet feed roller, each affecting the degree of resilient flexure of the sheet, optimization of the sheet conveyance operations is also attained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that forms an image on a moving image carrier;

a register roller that conveys a recording sheet onto which the image carrier transfers the image to a transfer position;

a sheet feed roller that conveys the recording sheet toward the register roller; and a conveyance control unit that conveys the recording sheet to the transfer position at a right timing with the image formed on the image carrier by driving the sheet feed roller and the register roller in accordance with a series of control operations, wherein the conveyance control unit controls rotation-start timings of the register roller and the sheet feed roller in such a manner that the recording sheet is conveyed, by exclusively driving the sheet feed roller at a specific rotation-start timing, stopping the sheet feed roller at a specific stop timing after the specific rotation-start timing and causing the sheet feed roller to remain stopped for a specific time period to allow the recording sheet to be, at an end of said specific time period, in a state of being resiliently flexed against the register roller, driving the sheet feed roller to start rotation again after the end of said specific time period and at the right timing with the image formed on the image carrier, and after the sheet feed roller starts rotation again, driving the register roller at a rotation-start timing of the register roller at a time of starting a registering process to convey the recording sheet to the transfer position.

2. The image forming apparatus according to claim 1, further comprising a sheet-type-information obtaining unit that obtains information on a sheet type of the recording sheet, wherein the conveyance control unit includes a rotation-start-timing changing unit that changes the rotation-start timing of the sheet feed roller based on the information on the sheet type obtained by the sheet-type-information obtaining unit.

3. The image forming apparatus according to claim 2, wherein the rotation-start-timing changing unit includes in advance a database in which a relation between the rotation-start timing and the sheet type is defined, acquires a rotation-start timing corresponding to the information on the sheet type obtained by the sheet-type-information obtaining unit from the database, and uses an acquired rotation-start timing in an operation of controlling a start of the registering process.

4. The image forming apparatus according to claim 1, further comprising:

a sheet-type-information obtaining unit that obtains information on a sheet type of the recording sheet; and a temperature-humidity detecting unit that detects a temperature and a humidity inside the apparatus, wherein the conveyance control unit includes a rotation-start-timing changing unit that changes the rotation-start timing of the sheet feed roller based on a combination of the information on the sheet type obtained by the sheet-type-information obtaining unit and the temperature and the humidity detected by the temperature-humidity detecting unit.

5. The image forming apparatus according to claim 4, wherein the rotation-start-timing changer includes in advance a database in which a relation between the rotation-start timing and the information on the sheet type and the temperature and the humidity is defined, acquires a rotation-start timing corresponding to the information on the sheet type obtained by the sheet-type-information obtaining unit and the temperature and humidity detected by the temperature-humidity detecting unit from the database, and uses an acquired rotation-start timing in an operation of controlling a start of the registering process.

6. The image forming apparatus according to claim 1, further comprising:

a plurality of types of available sheet feed rollers; and a feed-roller-type-information obtaining unit that obtains information indicating a type of the sheet feed roller being used, wherein the conveyance control unit includes a rotation-start-timing changing unit that changes the rotation-start timing of the sheet feed roller based on the information indicating the type of the sheet feed roller obtained by the feed-roller-type-information obtaining unit.

7. The image forming apparatus according to claim 6, wherein the rotation-start-timing changing unit includes in advance a database in which a relation between the rotation-start timing and the type of the sheet feed roller is defined, acquires a rotation-start timing corresponding to the information indicating the type of the sheet feed roller obtained by the feed-roller-type-information obtaining unit from the database, and uses an acquired rotation-start timing in an operation of controlling a start of the registering process.

8. The image forming apparatus according to claim 1, further comprising:

a plurality of types of available sheet feed rollers;

a feed-roller-type-information obtaining unit that obtains information indicating a type of the sheet feed roller being used; and a feed-roller-time-change-information obtaining unit that obtains information indicating a time change of the sheet feed roller being used, wherein the conveyance control unit includes a rotation-start-timing changing unit that changes the rotation-start timing of the sheet feed roller based on a combination of the information indicating the type of the sheet feed roller obtained by the feed-roller-type-information obtaining unit and the information indicating the time change of the sheet feed roller obtained by the feed-roller-time-change-information obtaining unit.

9. The image forming apparatus according to claim 8, wherein the rotation-start-timing changer includes in advance a database in which a relation between the rotation-start timing and the information indicating the type of the sheet feed roller and the information indicating the time change of the sheet feed roller is defined, acquires a rotation-start timing corresponding to the information indicating the type of the sheet feed roller obtained by the feed-roller-type-information obtaining unit and the information indicating the time change of the sheet feed roller obtained by the feed-roller-time-change-information obtaining unit from the database, and uses an acquired rotation-start timing in an operation of controlling a start of the registering process.

10. The image forming apparatus according to claim 2, wherein the conveyance control unit includes a compensating unit that compensates a device-dependent varying rotation-start timing that is different depending on an individual device being used.

11. The image forming apparatus according to claim 4, wherein the conveyance control unit includes a compensating unit that compensates a device-dependent varying rotation-start timing that is different depending on an individual device being used.

12. The image forming apparatus according to claim 6, wherein the conveyance control unit includes a compensating unit that compensates a device-dependent varying rotation-start timing that is different depending on an individual device being used.

13. The image forming apparatus according to claim 8, wherein the conveyance control unit includes a compensating unit that compensates a device-dependent varying rotation-start timing that is different depending on an individual device being used.

14. The image forming apparatus according to claim 10, wherein the compensating unit includes in advance a database in which a relation between the rotation-start timing and information on a correction of the device-dependent varying rotation-start timing is defined, and acquires information on the correction of the device-dependent varying rotation-start timing corresponding to the information obtained by the sheet-type-information obtaining unit from the database, and uses a rotation-start timing compensated for based on acquired information on the correction of the inter-device-difference information in an operation of controlling a start of the registering process.

15. The image forming apparatus according to claim 11, wherein the compensating unit includes in advance a database in which a relation between the rotation-start timing and information on a correction of the device-dependent varying rotation-start timing is defined, and acquires information on the correction of the device-dependent varying rotation-start timing corresponding to pieces of information obtained by the sheet-type-information obtaining unit and the temperature-humidity detecting unit from the database, and uses a rotation-start timing compensated for based on acquired information on the correction of the inter-device-difference information in an operation of controlling a start of the registering process.

16. The image forming apparatus according to claim 12, wherein the compensating unit includes in advance a database in which a relation between the rotation-start timing and information on a correction of the device-dependent varying rotation-start timing is defined, and acquires information on the correction of the device-dependent varying rotation-start timing corresponding to the information obtained by the feed-roller-type-information obtaining unit from the database, and uses a rotation-start timing compensated for based on acquired information on the correction of the inter-device-difference information in an operation of controlling a start of the registering process.

17. The image forming apparatus according to claim 13, wherein the compensating unit includes in advance a database in which a relation between the rotation-start timing and information on a correction of the device-dependent varying rotation-start timing is defined, and acquires information on the correction of the device-dependent varying rotation-start timing corresponding to pieces of information obtained by the feed-roller-type-information obtaining unit and the feed-roller-time-change-information obtaining unit from the database, and uses a rotation-start timing compensated for based on acquired information on the correction of the inter-device-difference information in an operation of controlling a start of the registering process.

18. A method of controlling a conveyance of a sheet for an image forming apparatus that includes an image forming unit that forms an image on a moving image carrier, a register roller that conveys a recording sheet onto which the image carrier transfers the image to a transfer position, a sheet feed roller that conveys the recording sheet toward the register roller, and a conveyance control unit that conveys the recording sheet to the transfer position at a right timing with the image formed on the image carrier by driving the sheet feed roller and the register roller in accordance with a series of control operations, the method comprising:

exclusively driving the sheet feed roller at a specific rotation-start timing;

stopping the sheet feed roller at a specific stop timing after the specific rotation-start timing and causing the sheet feed roller to remain stopped for a specific time period to allow the recording sheet to be, at an end of said specific time period, in a state of being resiliently flexed against the register roller;

driving the sheet feed roller to start rotation again after the end of said specific time period and at the right timing with the image formed on the image carrier; and after the sheet feed roller starts rotation again, driving the register roller at a rotation-start timing of the register roller at a time of starting a registering process to convey the recording sheet to the transfer position.

19. The method according to claim 18, further comprising obtaining information on a sheet type of the recording sheet, wherein the driving includes changing the rotation-start timing of the sheet feed roller based on the information on the sheet type obtained at the obtaining.

20. The method according to claim 19, wherein the driving includes compensating a device-dependent varying rotation-start timing that is different depending on an individual device being used.

* * * * *